US005555691A

United States Patent [19]

Nguyen

[11] Patent Number: 5,555,691

[45] Date of Patent: Sep. 17, 1996

[54] DRYWALL REPAIR SYSTEM

[76] Inventor: Thanh T. Nguyen, 8102 Amelis, No. 511K, Houston, Tex. 77055

[21] Appl. No.: 532,848

[22] Filed: Sep. 22, 1995

[51] Int. Cl.[6] ..... E04G 23/02

[52] U.S. Cl. ..... 52/514; 52/127.5; 52/514.5; 52/742.1; 52/DIG. 1

[58] Field of Search ..... 52/514, 514.5, 52/127.2, 127.5, 127.6, 127.7, 742.1; 156/94

[56] References Cited

U.S. PATENT DOCUMENTS

| | | | |
|---|---|---|---|
| 3,325,955 | 6/1967 | Haut | 52/514 |
| 4,062,165 | 12/1977 | Marks et al. | 52/514 |
| 4,483,475 | 11/1984 | Whitaker | 227/147 |
| 4,715,151 | 12/1987 | Garblik | 52/514 X |
| 4,811,531 | 3/1989 | Vallerand | 52/514 X |
| 4,930,281 | 6/1990 | Martin et al. | 52/514 |
| 5,014,483 | 5/1991 | Southern | 52/514 |
| 5,117,605 | 6/1992 | Waldbeiser | 52/514 |
| 5,155,965 | 10/1992 | Tabei et al. | 52/514 X |
| 5,199,238 | 4/1993 | Maestas | 52/514 |
| 5,353,568 | 10/1994 | Silva | 52/514 |

*Primary Examiner*—Wynn E. Wood
*Assistant Examiner*—Laura A. Saladino
*Attorney, Agent, or Firm*—Richard L. Moseley

[57] ABSTRACT

A drywall repair kit which includes a hollow tubular guide and a solid plug for fitting into the guide. The solid plug includes adhesive on its insertion end to secure the plug in place. After the plug is secured the guide is removed. The length of the plug is only slightly less than the stud space between drywall sheets plus the thickness of the drywall.

6 Claims, 1 Drawing Sheet

DRYWALL REPAIR SYSTEM

BACKGROUND OF THE INVENTION

The present invention relates to a kit and method for repairing holes in a drywall. Drywall, also commonly known as sheetrock, is now widely used for the interior walls for many if not most modern structures. In many applications the drywall is applied to a frame, generally with the drywall being placed on both sides of the frame. Frames are currently made of studs comprising finished 2×4 pine lumber which are now 1 and ⅝ inches by 3 and ⅝ inches. The space between the drywall is thus the thickness of the stud.

The drywall consists of chalk like gypsum pressed between layers of paperboard and while it is quite rigid lengthwise it is quite fragile to side impact. These type of impacts are very common around households and in result in holes in the drywall which need to be patched to create a pleasant appearance. One method of patching such holes simply requires placing a paper or other surface over the hole and applying plaster. If the hole is large then a piece of drywall must be cut and fit to the hole. The attachment of the drywall piece is not always easy. Thus a simple and easy method of repairing holes in drywall was seen to be needed.

SUMMARY OF THE INVENTION

The present invention comprises a hollow tube guide which is used to measure a regular hole around the fracture and also to guide a solid plug having essentially the same dimensions as the inner dimensions of the hollow guide. The insertion end of the plug is provided with an adhesive to stick the plug to the surface of the drywall opposite the fracture. The length of the plug is substantially equal to the space between the two drywall surfaces—preferably somewhat smaller so that room is left to apply the layer of decorative plaster. After the plug is inserted and attached to the opposite drywall surface the guide is removed and the plaster applied. The plaster may then be sanded and painted. The drywall is thus repaired.

DESCRIPTION OF THE PREFERRED EMBODIMENT

For a detailed description of the preferred embodiment of the invention the reader is directed to FIGS. 1–5 in which like components are given like numeral for ease of reference.

Figure 1:
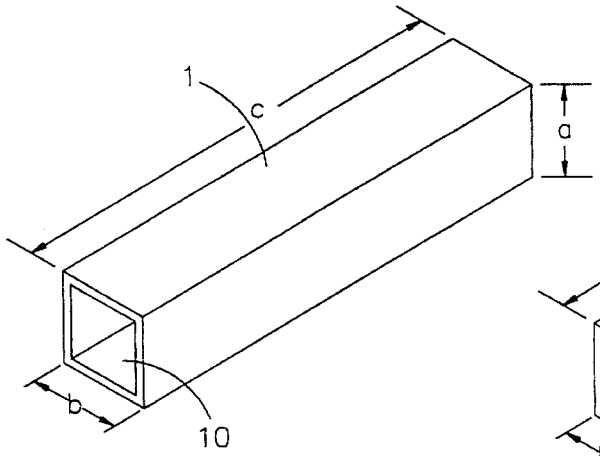
FIG. 1 is an isometric view of one embodiment of the hollow guide tube of the present invention.

FIG. 1 shows the hollow tubular guide 1 having internal square cross sectional 10 of dimensions a and b and a length c. The cross sectional area must be larger than the hole to be patched and length c should be slightly longer than the thickness of the drywall sheet plus the dimension between drywall sheets in a wall such that when inserted through the broken drywall and resting against the second sheet the guide extends somewhat to allow a hand grip—perhaps and inch or two. See FIG. 4. The total length of a preferred embodiment is about 5 to 6 inches.

Figure 2:
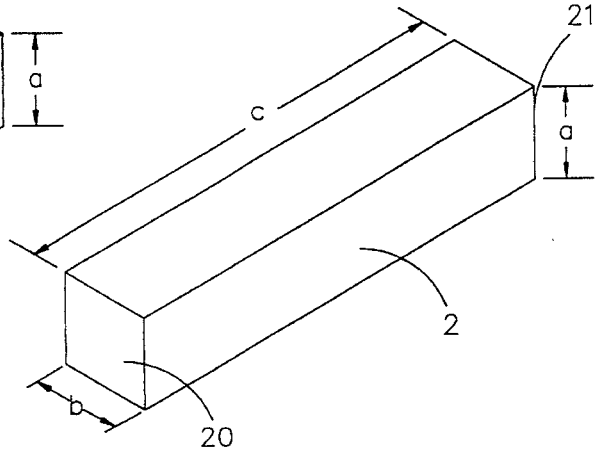
FIG. 2 is an isometric view of the plug used with the hollow guide tube of FIG. 1.

FIG. 2 shows the plug 2 which matches the guide 1. The plug may be hollow but must be closed at both ends 20 and 21. The dimensions of the plug are substantially the same as the internal dimensions of the guide except the length d is only equal to the thickness of the broken sheet of drywall and the space between the two sheets of drywall. See FIGS. 4 and 5. The preferred length d for a standard 2×4 stud spacing with ¾ inch drywall is thus about 3⅝+¾−1/16 (for filling)=3 5/16". Of course the total length will depend upon the thickness of the drywall but generally should be about 1/16" less than the total of the stud spacing+the drywall thickness.

Figure 3:
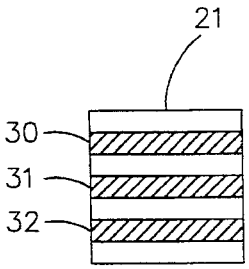
FIG. 3 is a rear view of the plug shown in FIG. 2

In FIG. 3 the insertion end or rear surface 21 of the plug 2 is shown. The strips 30, 31 and 32 of adhesive are attached to the rear surface 21.

Figure 4:
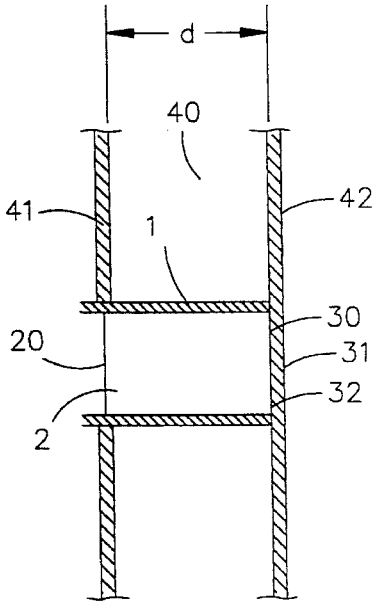
FIG. 4 is a side elevational view in partial cross section showing the guide and plug in place between two sheets of drywall.
Figure 5:
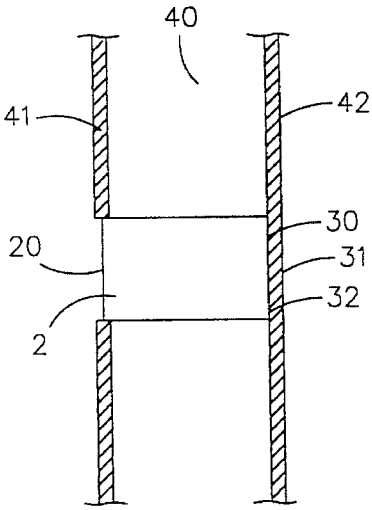
FIG. 5 is a side elevational view in partial cross section of the plug left in place when the guide is removed.

Referring now to FIGS. 4 and 5 the use of the guide 1 and plug 2 are shown. First a guide having a cross sectional area larger that the fracture is selected and used as a pattern to cut a smooth hole around the fracture having the same dimensions as the outer dimensions of the guide. The guide is then placed through the smooth hole in the fractured drywall sheet 41 and inserted until it rests against the second drywall sheet 42. The plug 2, with the adhesive strips exposed is then inserted in the guide and pressed in until the adhesive strips 30–32 are sticking to the second drywall sheet 42. The inserted plug is shown FIG. 4.

When the plug 2 is secured against the second drywall sheet 42 the guide 1 may be removed leaving the plug in the space 40, between the two drywall sheets as shown in FIG. 5. Plaster may be applied over the plug and painted to finish as desired.

It will be apparent to those skilled in the art that many modifications and changes in the apparatus may be made without departing from the scope and spirit of the invention. It is the intention, therefore, that the following claims cover all equivalent modifications and variations and fall within the scope of the invention as defined by the claims. While the guide and plug have been shown as square in cross sectional area any matching geometric tube and plug may be used. A cylindrical tube and plug may be desirable in some applications.

The adhesive for the insertion end of the plug may be provided as covered strips or may be added as a paste just prior to insertion.

The invention claimed is:

1. A drywall repair kit for repairing a drywall having two sheets of drywall separated by a stud spacing, comprising a hollow tubular guide open at both ends and a plug having essentially the same cross sectional dimension as said guide and closed at both ends, said plug having adhesive applied to one of said closed ends.

2. The drywall repair kit of claim 1 wherein the length of said guide is adapted to be about 1 to 2 inches longer than the stud spacing plus the drywall thickness.

3. The drywall repair kit of claim 1 where the length of the plug is adapted to be about 1/16 inch less than the stud spacing plus the drywall thickness.

4. The drywall repair kit of claim 1 wherein the cross sectional dimension of said guide and said plug is square.

5. A drywall repair kit for repairing a drywall having two sheets of drywall separated by a stud spacing, comprising:

(a) a hollow tubular guide open at both ends and adapted to have a length longer than the sum of the stud spacing and the thickness of the drywall;

(b) a plug having essentially the same cross sectional dimension as said guide and closed at both ends and adapted to have a length just slightly shorter than said the stud spacing and the thickness of the drywall; and (c) adhesive applied to one of said closed ends.

6. A method of repairing a fracture hole in one sheet of a drywall having two sheets of drywall separated by a stud spacing, comprising:

(a) selecting a hollow tubular guide which is slightly larger in cross sectional area than the fracture hole, said hollow tubular guide being open at both ends and having a length longer than the sum of said stud spacing and the thickness of said drywall;

(b) cutting a smooth hole about said fracture hole such that said smooth hole is substantially the same cross sectional area as the outer cross sectional area of said guide;

(c) inserting said guide through said smooth hole until the rear of the guide rests against the second sheet of drywall;

(d) inserting a plug having substantially the same cross sectional dimension as said guide into said guide, said plug being closed at both ends and having a length just slightly shorter than said stud spacing and the thickness of said drywall and having adhesive applied to the inserted end such that said plug is secured to second sheet of drywall;

(e) removing said guide; and (f) applying plaster over said plug.

* * * * *